US008038173B2

(12) United States Patent
Canale

(10) Patent No.: US 8,038,173 B2
(45) Date of Patent: Oct. 18, 2011

(54) TELESCOPIC EXTENSION FOR AN ELECTRIC HOUSEHOLD APPLIANCE

(75) Inventor: Giuseppe Canale, Gorla Minore (VA) (IT)

(73) Assignee: OMEC S.p.A., Gorla Minore (VA) (IT)

( * ) Notice: Subject to any disclaimer, the term of this patent is extended or adjusted under 35 U.S.C. 154(b) by 0 days.

(21) Appl. No.: 12/295,444

(22) PCT Filed: Mar. 15, 2007

(86) PCT No.: PCT/EP2007/002323

§ 371 (c)(1),
(2), (4) Date: Aug. 3, 2009

(87) PCT Pub. No.: WO2007/112839

PCT Pub. Date: Oct. 11, 2007

(65) Prior Publication Data

US 2010/0001511 A1 Jan. 7, 2010

(30) Foreign Application Priority Data

Mar. 31, 2006 (IT) ..... MI2006A0616

(51) Int. Cl.
*F16L 39/04* (2006.01)

(52) U.S. Cl. ..... 285/7; 285/303

(58) Field of Classification Search ..... 285/7, 298, 285/303, 302

See application file for complete search history.

(56) References Cited

U.S. PATENT DOCUMENTS 5,692,782 A * 12/1997 Fischer ..... 285/7
6,454,308 B1 * 9/2002 Kim ..... 285/7
6,494,492 B1 * 12/2002 Ha ..... 285/7
6,513,191 B1 * 2/2003 Kim ..... 285/7

FOREIGN PATENT DOCUMENTS

| | | |
|---|---|---|
| CN | 1 751 649 | 3/2006 |
| DE | 196 15 814 A1 | 10/1996 |
| DE | 102 41 129 | 12/2003 |
| EP | 0 552 481 | 7/1993 |
| EP | 0 553 482 A1 | 8/1993 |
| EP | 0 520 534 B1 | 5/1994 |

(Continued)

OTHER PUBLICATIONS

International Search Report for PCT/EP2007/002323, mailed Aug. 20, 2007.

*Primary Examiner* — David E Bochna
(74) *Attorney, Agent, or Firm* — Nixon & Vanderhye, P.C.

(57) ABSTRACT

A telescopic extension (1) for an electric household appliance is described, said extension comprising: an inner tube (2) and an outer tube (3) which are slidable one inside the other; a sleeve (4) fixed to the outer tube; a fastener (5) able to lock together said inner tube and the outer tube; a slider co-operating with the fastener via the action of a first spring and a second spring (73); and an actuating handle (8) operationally connected to said slider. The inner tube is provided with a plurality of recesses (23) able to receive, at least partially, the fastener. The outer tube comprises a tunnel (31) for retaining the slider and for guiding it during displacement. The tunnel is formed by suitably shaping the outer tube. The sleeve comprises a recessed area (46) for retaining the slider and guiding it during displacement.

16 Claims, 8 Drawing Sheets

FOREIGN PATENT DOCUMENTS

| | | |
|---|---|---|
| EP | 0 987 976 | 3/2000 |
| EP | 1 092 383 | 4/2001 |
| EP | 1 333 747 B1 | 4/2006 |
| WO | 00/08997 | 2/2000 |
| WO | 01/97672 | 12/2001 |
| WO | 02/38026 | 5/2002 |
| WO | 2004/049891 | 6/2004 |
| WO | 2007/030979 | 3/2007 |

* cited by examiner

TELESCOPIC EXTENSION FOR AN ELECTRIC HOUSEHOLD APPLIANCE

This application is the U.S. national phase of International Application No. PCT/EP2007/002323 filed 15 Mar. 2007 which designated the U.S. and claims priority to IT MI2006A000616 filed 31 Mar. 2006, the entire contents of each of which are hereby incorporated by reference.

The present invention relates to a telescopic extension for an electric household appliance, such as a vacuum cleaner and the like.

BACKGROUND

The known telescopic extensions for electric household appliances comprise an inner tube and an outer tube sealingly slidable one inside the other, a sleeve, a fastening means adapted to lock together the inner tube and outer tube, a thrusting slider engaging with the fastening means via the action of resilient means and actuating means operationally connected to the thrusting slider. In these extensions, the inner tube is provided with a row of notches of predefined shape and the sleeve is fixed to the outer tube.

Telescopic extensions of the abovementioned type are known, for example, from EP 1 092 383 A1, EP 0 520 534 B1, EP 0 987 976 B1 and EP 01993418.1, all in the name of the same Applicant. The telescopic extensions mentioned above are all very efficient and practical to use.

Other telescopic extensions are known from EP 0 552 481 B1, EP 0 553 482 A1 and DE 196 15 814 A1.

In particular, EP 0 552 481 describes a telescopic tube for electric household appliances with an inner tube and outer tube slidable one inside the other; a sleeve fixed to the outer tube; and a fastening means able to lock together the inner tube and the outer tube. An actuating pushbutton consisting of two pieces retained in a central position by two springs is provided in the telescopic tube according to EP 0 552 48. The bottom piece of the actuating pushbutton has outwardly projecting parts which are engaged via a cavity in the top part of the two-piece pushbutton. The sleeve is housed inside a cavity formed by flaring the outer tube in the vicinity of its end.

The telescopic tube for an electric household appliance according to EP 0 552 481 has various drawbacks. The flaring is a costly operation which increases greatly the cross section of the telescopic tube. Moreover, it greatly stresses the metallic walls of the tube, weakens them and very often causes damage which results in rejection of the finished part. This results in high production costs. In order to prevent the outer tube from rotating with respect to the inner tube, a longitudinal relief must be necessarily provided in the inner tube and a corresponding longitudinal recess provided in the outer tube.

The telescopic tube for an electric household appliance according to EP 0 552 481 is difficult to assemble owing to the outwardly projecting parts of the bottom piece of the actuating pushbutton. In fact, the bottom part of the pushbutton cannot be mounted by inserting the sleeve in the outer tube. The bottom part of the pushbutton must be mounted from above and this operation is difficult owing to the presence of the two springs. Assembly therefore cannot be automated.

The telescopic tube for an electric household appliance according to EP 0 552 481 is not considered safe owing to the fact that the top part of the pushbutton may be separated from the bottom part and the entire device may therefore break and become unusable.

The Applicant, in particular, has perceived the need to reduce the number of components which form the mechanism and provide a mechanism which is easy to assemble.

The Applicant has also perceived the need to provide a telescopic extension which is strong and entirely reliable in any operating condition.

According to the technology disclosed herein a telescopic extension for an electric household appliance is provided, said extension comprising: an inner tube and an outer tube which are slidable one inside the other; a sleeve fixed to the outer tube; a fastening means adapted to lock together the inner tube and the outer tube; a slider co-operating with the fastening means via the action of a first spring-land a second spring; and an actuating handle operationally connected to said slider. The inner tube is provided with a plurality of recesses able to receive, at least partially, the fastening means. The outer tube comprises a tunnel for retaining the slider and for guiding it during displacement; the tunnel is formed by suitably shaping the outer tube. The sleeve comprises a recessed area for retaining the slider and guiding it during displacement. The inner tube has a depression forming a channel which extends longitudinally. Recesses for the fastening means are provided on the bottom of the channel.

Conveniently, the tunnel has two sides walls and a ceiling which connects together the two side walls.

In an advantageous embodiment, the tunnel comprises at least two windows formed in the ceiling of the tunnel, the two windows defining between them a central connecting strip which connects the two side walls of the tunnel.

Conveniently, the surface of the slider is in contact, at least partially, with the central connecting strip in any operating condition of the slider. The surface of the slider which is in contact, at least partially, with the central connecting strip is flat and does not have parts projecting from the ceiling of the tunnel.

Preferably the actuating handle comprises a longitudinal recess for receiving the tunnel of the outer tube. The actuating handle comprises two teeth projecting from the bottom of the longitudinal recess, the distance between the two teeth corresponding to the length of the slider.

The end surface of the teeth conveniently has a rounded form for retaining the springs.

The slider conveniently comprises two side holes for receiving a respective end of the two springs.

The actuating handle preferably consists of two pieces and comprises means for locking together the two pieces.

According to a second aspect, the technology disclosed herein relates to an electric household appliance comprising a telescopic extension as mentioned above.

The telescopic extension of the technology disclosed herein has the advantage of being extremely compact and particularly resistant to the operating stresses such as axial thrusts, transverse thrusts and twisting moments.

Moreover, it may be assembled using a significantly simplified process which allows a reduction in the time and production costs and may be easily automated.

BRIEF DESCRIPTION OF THE DRAWINGS

Characteristic features and advantages of the technology disclosed herein will now be described with reference to an embodiment represented by way of example in the accompanying drawings in which.

DETAILED DESCRIPTION

Figure 1:
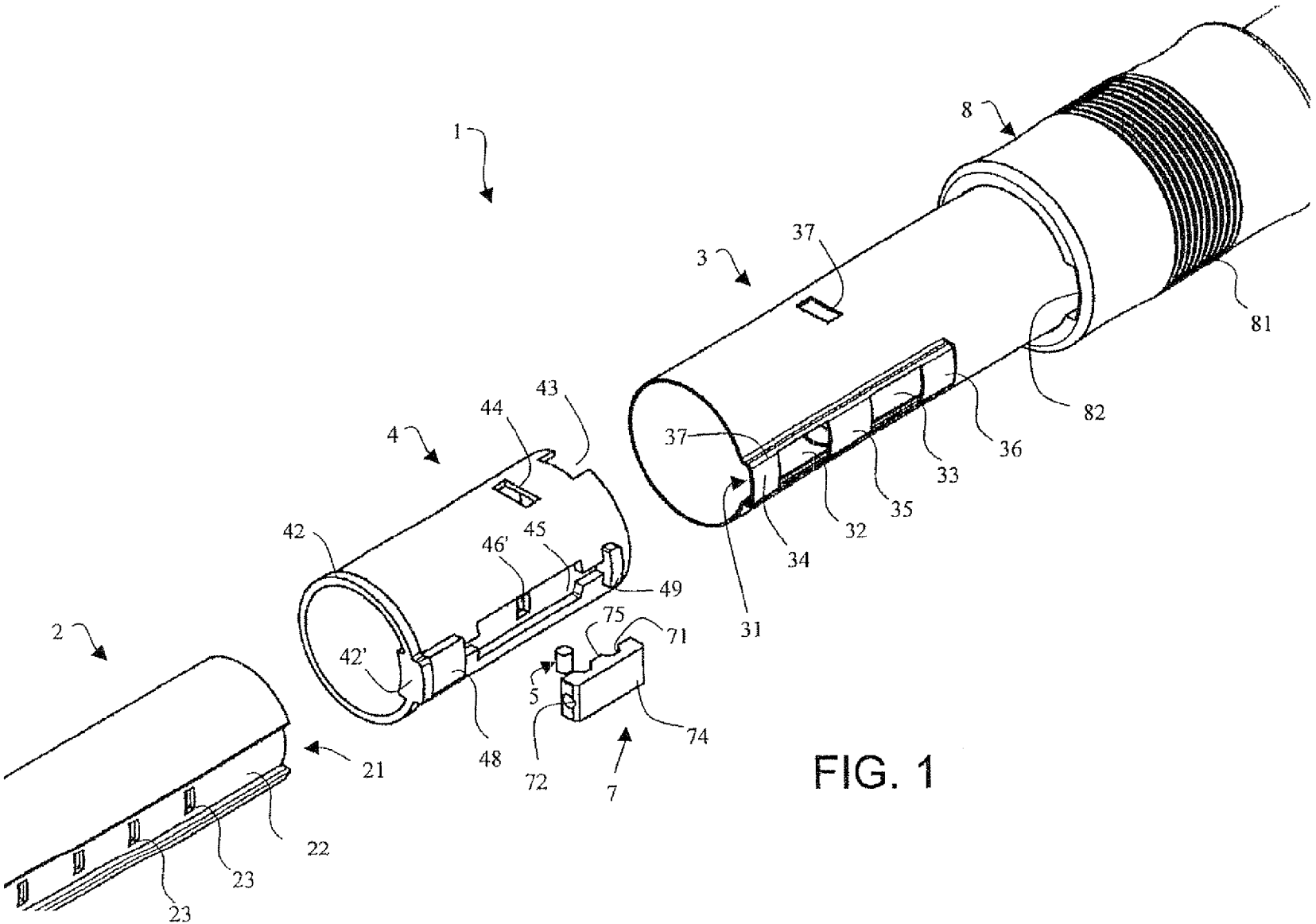
FIG. 1 is an exploded view of a section of a telescopic extension for an electric household appliance according to an embodiment of the technology disclosed herein.

FIG. 1 shows, in an exploded view, a section of a telescopic extension 1 for an electric household appliance, such as a vacuum cleaner or the like. The extension 1 comprises an inner tube 2, an outer tube 3, a sleeve 4, fastening means 5, a slider 7 and an actuating handle 8.

The inner tube 2 has preferably a cross-section which is roughly circular, but has a depression 21 which forms a channel 22 preferably with a flat bottom. The channel formed by the depression 21 extends longitudinally parallel to the longitudinal axis of the inner tube. Recesses 23 are provided on the bottom 22 of the channel. According to a preferred embodiment, said recesses have a substantially semi-cylindrical shape. Alternatively, they may be semi-spherical. The inner tube 2 is preferably made of metal, for example steel, aluminum or alloys thereof.

The outer tube 3 has preferably a cross-section which is roughly circular, but has a tunnel 31 projecting outwards from the cross-section of the outer tube 3. The tunnel 31 extends longitudinally parallel to the longitudinal axis of the outer tube 3. The tunnel 31 extends over a relatively short section of the outer tube 3. By way of example, the tunnel 31 extends over about 5 cm. The height of the tunnel 31 is equal to a few mm. The outer tube 3 is preferably made of metal, for example steel, aluminum or alloys thereof.

The tunnel 31 is formed with two side walls 37 and a ceiling 38 which connects the two side walls 37. It should be mentioned at this point that the tunnel 31 is not comparable in any way with a flaring (such as that described in EP 0 552 481). The flaring is a widening of the diameter of the tube along the entire circumference. This causes major stressing of the tube such that in many cases it breaks or in any case becomes unusable. Moreover, the flaring increases considerably the dimensions of the tube. The tunnel, instead, constitutes a "localized" and small-size widening of the diameter of the outer tube which can be produced easily and at a low cost. It does not cause major stressing and does not increase substantially the external dimensions.

Two windows 32, 33 are formed in the tunnel 31. The ceiling 38 of the tunnel 31 is thus formed by three strips 34, 35 and 36 The strip 34 is the one situated closest to the tunnel entrance; the strip 35 is the central one; and the strip 36 is the one situated at the end of the tunnel, where it is connected to the outer tube 3 which assumes a circular cross-section. The windows 32, 33 may extend as far as the side walls 37 of the tunnel 31 or may terminate before them so that a thin ceiling edge remains connected to the side walls 37 opposite the windows 32, 33.

Conveniently, two bosses 39 are provided on the outer tube 3 so as to favour locking of the sleeve 4 to the outer tube 3.

Figure 5A:
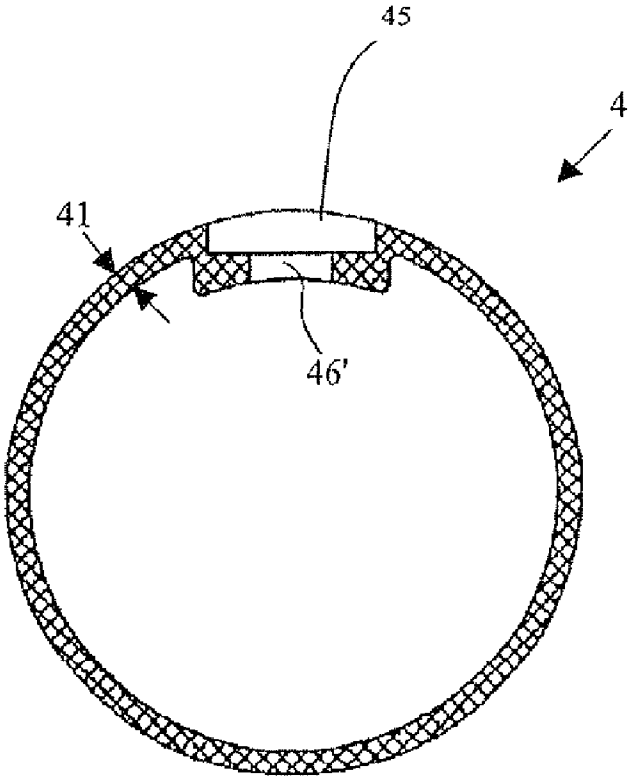
FIG. 5A is a cross-sectional view of the sleeve, taken along the line 2-2 of FIG. 2.
Figure 4:
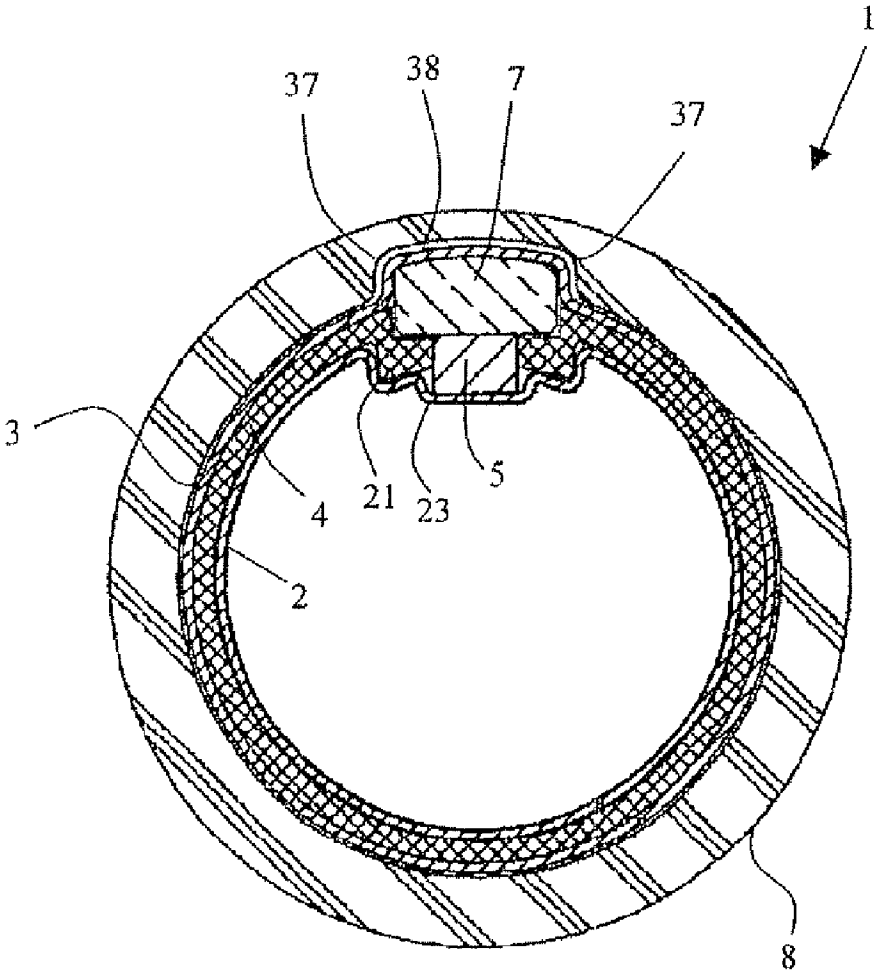
FIG. 4 is a cross-sectional view of the telescopic extension according to FIG. 1, taken along the line 2-2 of FIG. 2.

The sleeve 4 has preferably a roughly circular cross-section which is also visible in FIG. 5A. The sleeve 4 is essentially a tube, preferably made of plastic, with a thickness 41. The outer diameter of the sleeve 4 corresponds substantially to the inner diameter of the outer tube 3.

Figure 5B:
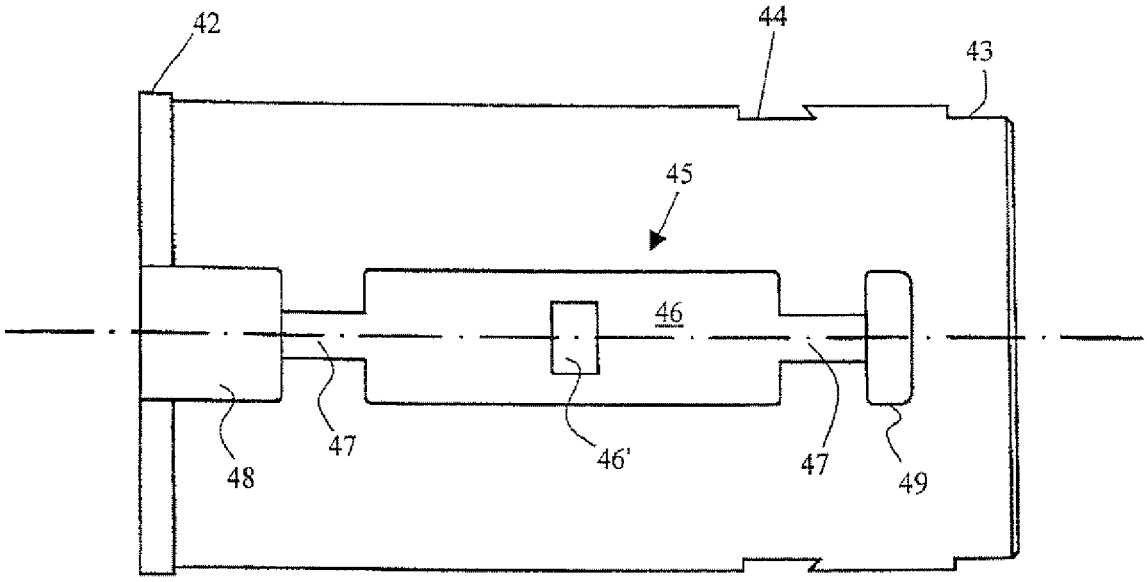
FIG. 5B is a top plan view of the sleeve.
Figure 5C:
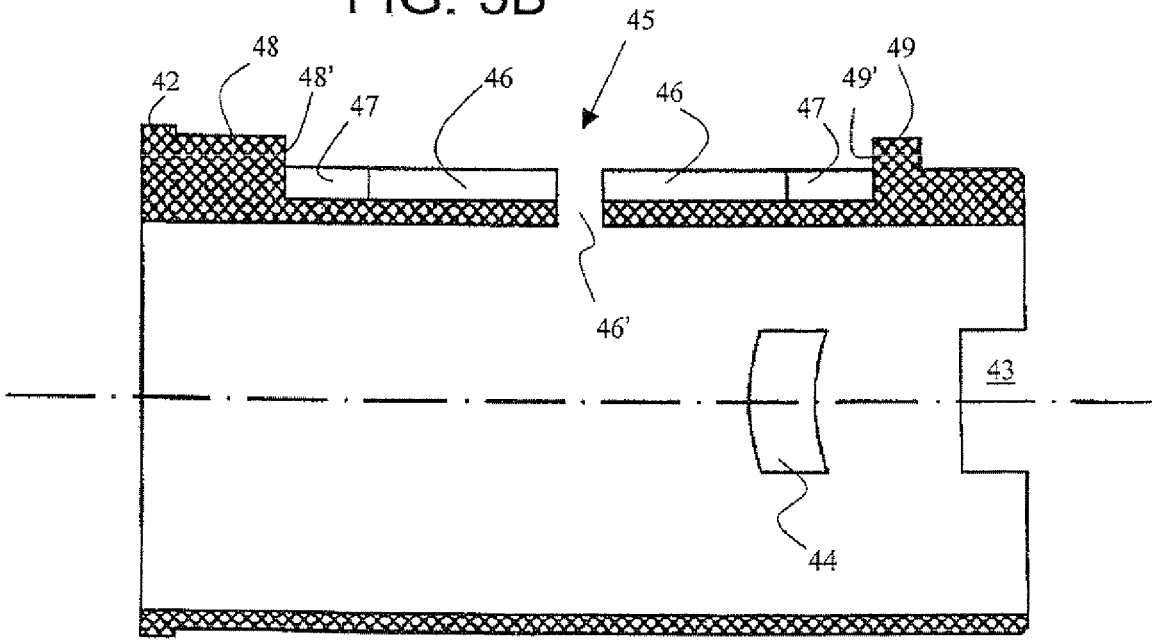
FIG. 5C is a longitudinally sectioned view of the sleeve.

Reference shall now be made to FIGS. 5B and 5C.

A ring 42 with a diameter greater than the outer diameter of the sleeve is provided at a first end of the sleeve 4. The opposite end of the sleeve 4 is provided with two receiving notches 43 and two respective windows 44 co-operating with the bosses 39 of the outer tube 3. An inner relief 42' allows centring of the sleeve 4 with respect to the inner tube 2.

A suitably shaped recessed area 45 is formed in the thickness 41 of the sleeve 4. An opening 46' for the fastening means 5 is provided in the centre of the recessed area 45. The recessed area 45 has the shape of an elongated rectangle 46; it continues with two narrower sections 47 and terminates in two respective projecting blocks 48, 49. The projecting blocks 48, 49 project from the cross-section of the sleeve 4 and have a sectional form substantially complementing that the tunnel 31. The width of the recessed area, in the region of its rectangular central part 46, is equal to the width of the slider 7.

Figure 2:
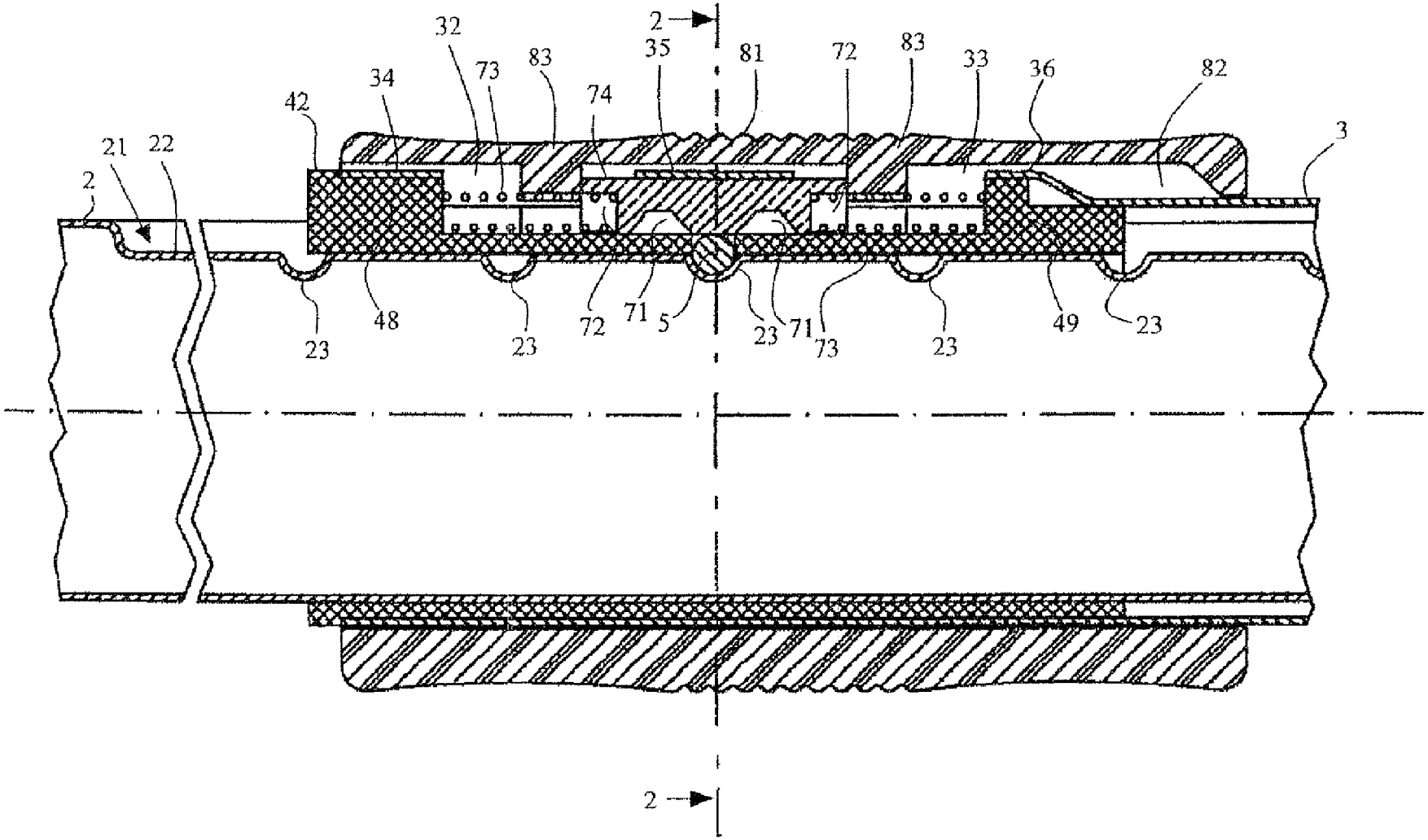
FIG. 2 is a longitudinally sectioned view of the telescopic extension according to FIG. 1, mounted and in a first operating condition.
Figure 3:
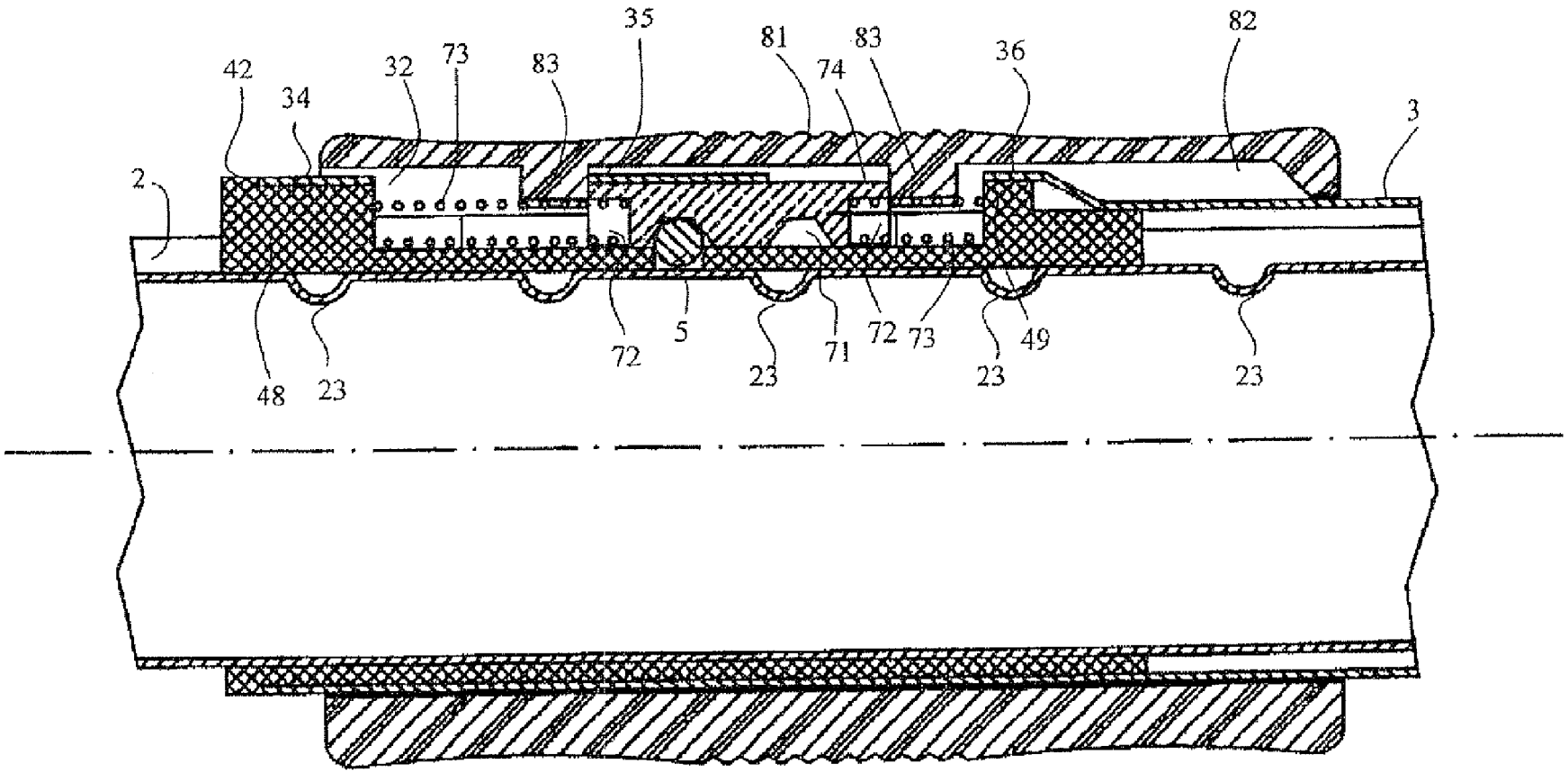
FIG. 3 is a longitudinally sectioned view of the telescopic extension according to FIG. 1, mounted and in a second operating condition.

The slider 7 is shown in FIGS. 1, 2, 3 and 4. The slider 7 is a substantially parallelepiped part with a flat upper side 74 and a bottom side 75 provided with two symmetrically arranged notches 71. Two blind holes 72 for receiving two respective cylindrical springs 73 are formed on the sides of the slider (FIGS. 2 and 3). Preferably, the springs 73 have the same length and the same properties. Preferably, the slider 7 is made of metal, for example steel, aluminum or alloys thereof. Alternatively, the slider 7 may be made of plastic.

The fastening means 5 is shown in FIGS. 1, 2, 3 and 4. It is in the form of a cylinder piece 5, but alternatively may be a spherical body.

The actuating handle 8 of the telescopic extension according to the technology disclosed herein is shown in FIGS. 1, 2, 3, 4 and 6. The actuating handle 8 has a tubular shape and is preferably made of plastic. Externally, it has a knurled area 81 for improving the grip in any operating condition. The ends are preferably chamfered or rounded.

Figure 6B:
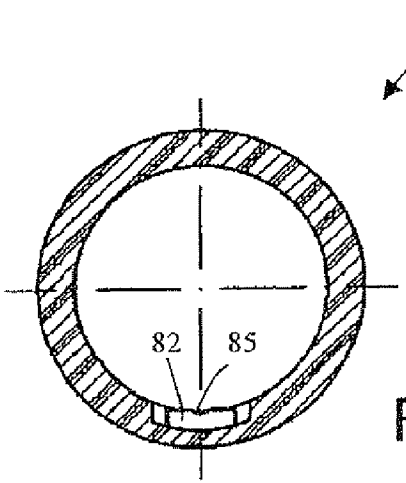
FIG. 6B is a cross-sectional view of the actuating handle.
Figure 6D:
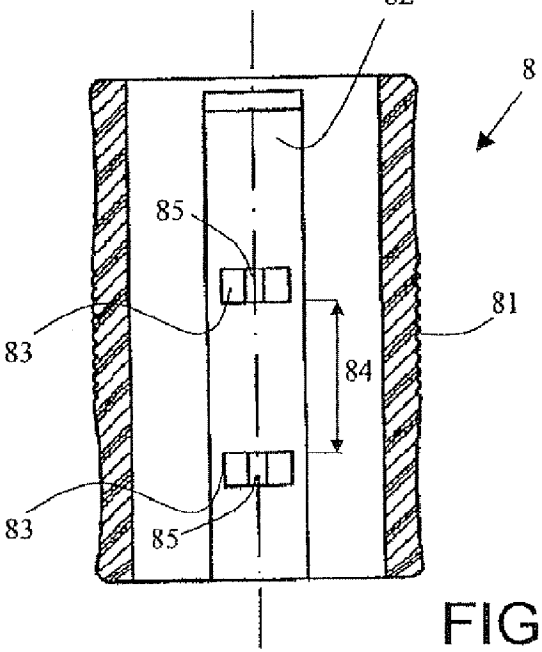
FIG. 6D is a second longitudinally sectioned view of the actuating handle.
Figure 6A:
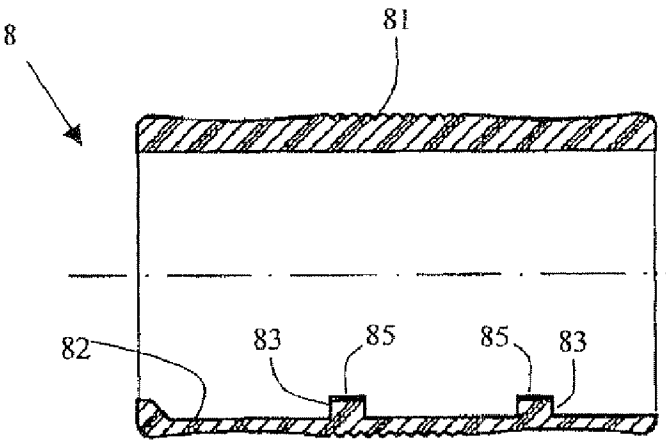
FIG. 6A is a first longitudinally sectioned view of the actuating handle.
Figure 6C:
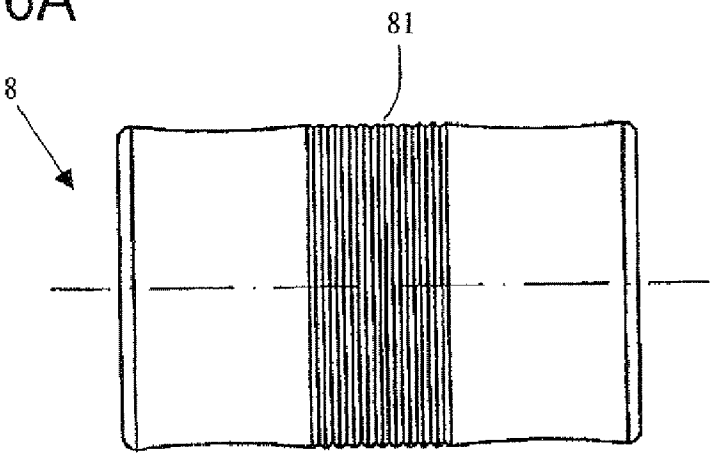
FIG. 6C is a plan view of the actuating handle.

Internally, the actuating handle has a substantially circular cross-section with a diameter substantially corresponding to the external diameter of the outer tube 3. However, as shown in FIGS. 6B and 6C, a longitudinal recess 82 is provided so as to receive the tunnel 31 of the outer tube 3 (FIG. 1). Two teeth 83 projecting from the bottom of the longitudinal recess 82 are also provided. The end surface 85 of the teeth 83 preferably has a rounded shape for retaining the springs 73. The distance 84 (FIG. 6D) between the two teeth 83 corresponds to the length of the slider 7 (FIG. 2 and FIG. 3).

The cross-sections in FIGS. 2 and 3 show the telescopic extension 1 according to an embodiment of the technology disclosed herein, completely assembled and in two different operating configurations.

In order to assemble the telescopic extension 15 the sleeve 4 is fitted onto the inner tube 2. The fastening means 5 is then inserted into the window 46', the slider 7 is mounted and the springs are placed inside their seats 47 (preferably slightly pre-tensioned). Alternatively, the fastening means may be inserted together with the slider 7 (for example using a magnet). The sleeve thus equipped is inserted inside the outer tube 3 until the ring 42 comes up against the edge of the outer tube 3. The height of the ring 42 with respect to the projecting block 48 is such that the ring 42 is flush with the outer tube 3. Finally, the actuating handle is locked against the outer tube.

The projecting block 48 is retained by the strip 34 of the tunnel 31 and the projecting block 49 is retained by the strip 36 of the tunnel 31.

The slider 7 is seated inside the recessed area 45 and in particular inside its central part 46. The central part 46 therefore acts as a guide for the slider. The slider 7 is retained by the metallic central strip 35 of the tunnel 31. The bottom side 75 of the slider 7 provided with the incisions 71 faces the sleeve 4.

In the operating configuration shown in FIG. 2, the slider 7 is kept in the centre of the recessed area 45 of the sleeve 4 by means of the two springs 73. The two cylindrical springs 73 are partially inserted inside the holes 72 of the slider and bear with their ends against the shoulder surfaces 48' and 49' (FIG. 5C) of the projecting blocks 48 and 49.

In the operating configuration shown in FIG. 2 the fastening means 5 is retained by the bottom side 75 of the slider 7 inside the recess 23 of the inner tube 2. In this operating configuration the two tubes 2 and 3 are locked together.

In order to release the two tubes 2 and 3, the actuating handle 8 is pushed to the right (as shown in FIG. 3) or to the left. When the handle 8 is pushed to the right, for example, the slider 7 is correspondingly displaced to the right. The right-hand spring 73 is compressed, while the left-hand spring 73 is extended. In any case, during its displacement, the slider 7 is guided by the central part 46 of the recessed area 45 and is retained by the metallic central strip 35 of the tunnel 31. The fastening means 5 moves out of its recess 23 and is seated inside an incision 71 and inside the opening 46' of the sleeve. Owing to its shape, the fastening means (for example in the form of a cylinder piece) is able to roll on the inner tube.

When the cylinder piece 5 is against situated opposite a recess 23 and the force on the handle is released, locking together of the outer tube 3 and inner tube 2 will again occur.

Figure 7A:
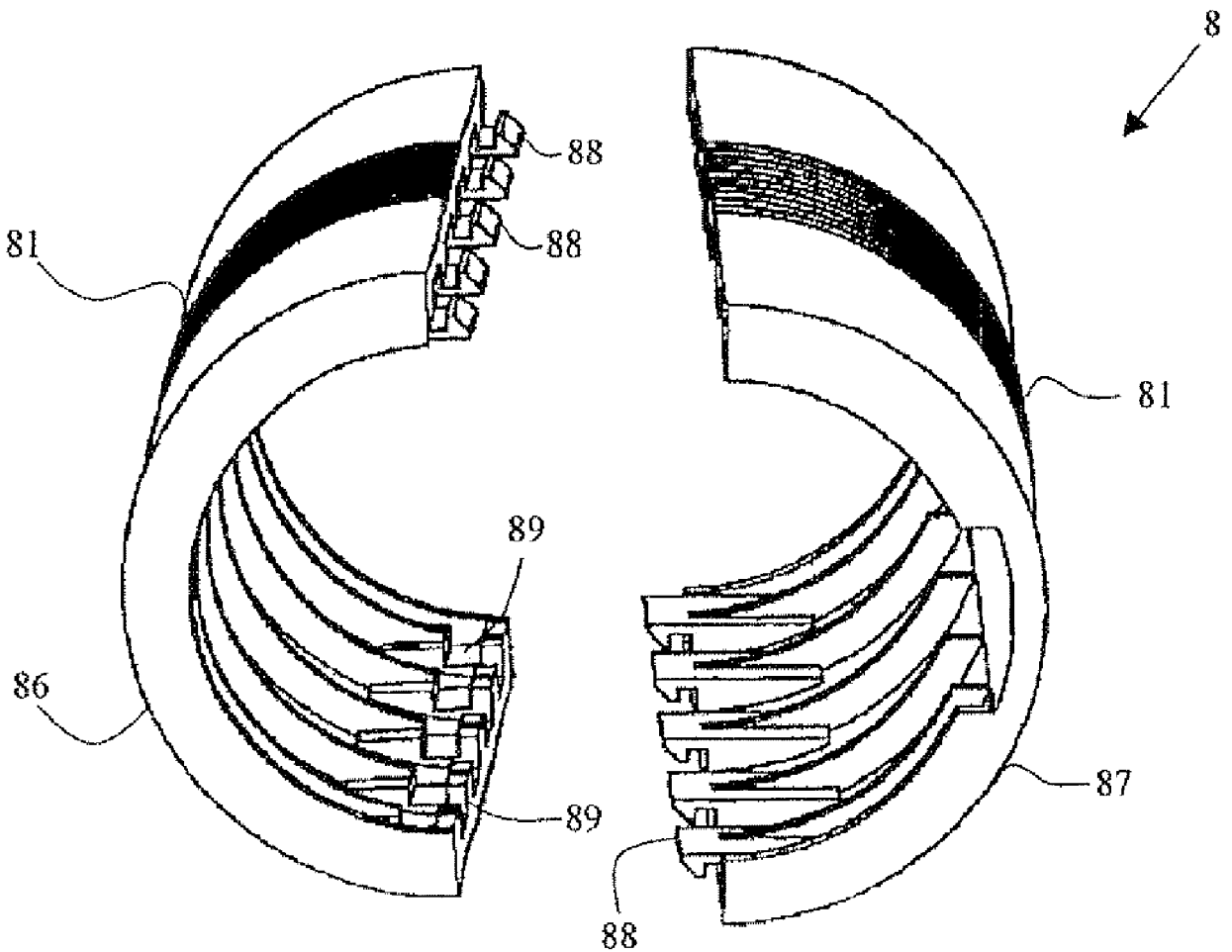
FIG. 7A is an exploded axonometric view of the actuating handle.
Figure 7B:
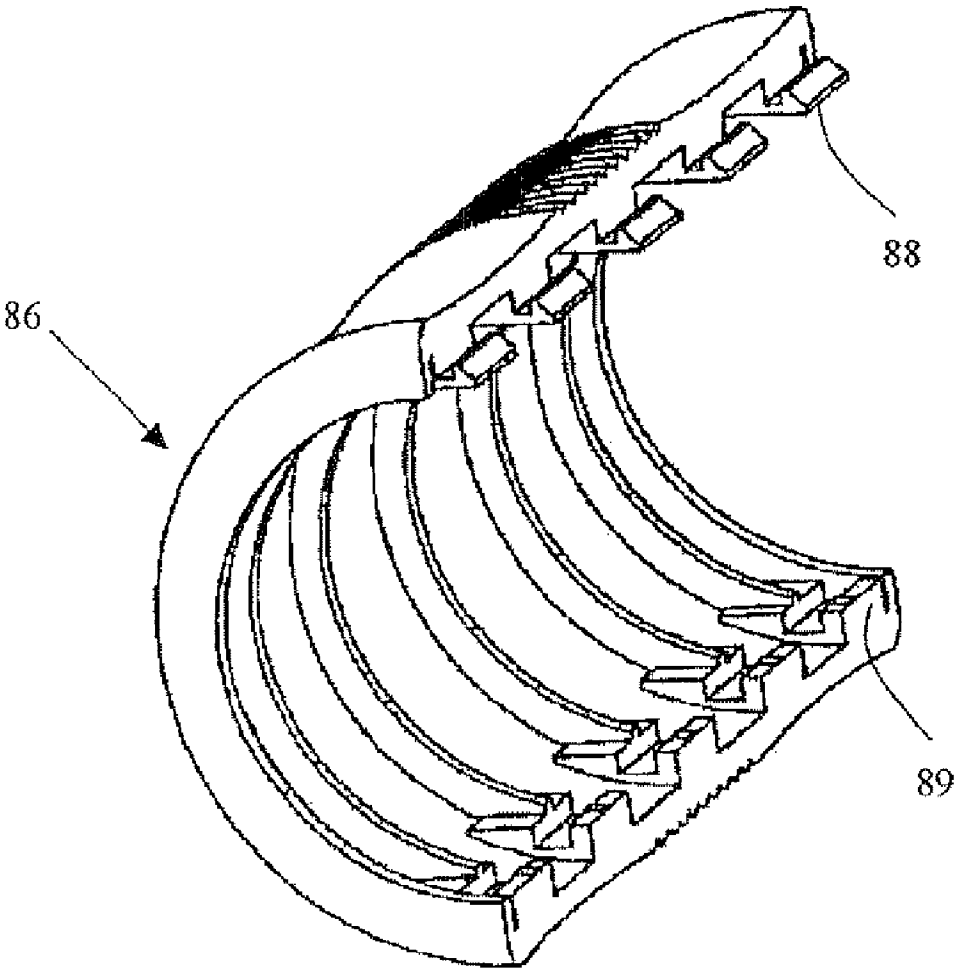
FIG. 7B is an axonometric view, from the inside, of a half-part of the actuating handle.

According to an advantageous embodiment, the actuating handle 8 is formed by two pieces 86 and 87 (FIGS. 7A and 7B). Each handle half-piece 86, 87 comprises projecting engaging teeth 88 and/or corresponding engaging blocks 89. When the two handle half-pieces 86, 87 are forced together, the engaging teeth 88 engage with the engaging blocks 89 in a permanent and lasting manner.

The handle for the telescopic extension according to the technology disclosed herein may be formed by two pieces also because it exerts a minimum force. In fact, the handle engages with the slider and only has the function of displacing it in one direction or the other. The slider is guided inside the recess of the sleeve and, on the opposite side, by the tunnel ceiling (and in particular by the strip 35). The handle must not retain the slider in position and prevent it from coming out of its seat Various advantages are provided by the technology disclosed herein compared to the known telescopic extensions. One of the main advantages is the ease of assembly. The ease of assembly (and the possibility of automating assembly) is of fundamental importance in this kind of article in order to reduce costs and make the telescopic extension economically advantageous. In fact, it is sufficient to keep the slider 7 with the two springs 73 and the fastening means 5 against the sleeve and insert the sleeve thus equipped inside the outer tube. Once the sleeve has been inserted to the point where the slider 7 reaches the strip 34, there is no longer the risk of the slider coming out of its seat. In fact, it is retained inside the tunnel 31, in particular by the central strip 35. The size of the windows 32 and 33 is also such that the slider is unable to pass out through them.

A machine (not shown) with a head-piece able to keep the cylinder piece 5, the slider 7 and the springs 73 in position inside the sleeve 4 is used for assembly. In order to prevent the cylinder piece from coming out, obviously the sleeve 4 must be fitted onto the inner tube. As mentioned above, the inner relief 42' allows centering of the sleeve 4 with respect to the inner tube 2. The two parts are unable to rotate relative to each other.

The actuating handle 8 may be mounted on the outer tube very easily and without the risk of the springs and/or the slider coming out of their seats.

A second important advantage is the robustness of the telescopic extension in any operating condition and its reliability over time. In fact, the slider 7 is situated between the sleeve 4 and the tunnel 31 of the outer tube 3. The tunnel 31 forms part of the outer tube 3 and is advantageously made of metal. The slider 7 may simply be displaced along a guided path: on the one hand, it is guided by the tunnel 31 (in particular by the ceiling 38, mainly formed by the strips 34, 35 and 36, and by the side walls 37) and, on the other hand, it is guided by the central part 46 of the recessed area 45. The tunnel 31 formed in the outer tube is very strong since the outer tube may be made of metal. Therefore, in any operating condition (for example when the slider is displaced so as to move the cylinder piece 5 out of the recess 23), the strips 34, 35 and 36 will prevent the slider from moving radically outwards.

The invention claimed is:

1. A telescopic extension for an electric household appliance comprising:

a) an inner tube and an outer tube which are slidable one inside the other;

b) a sleeve fixed to said outer tube;

c) fastening means adapted to lock together said inner tube and said outer tube;

d) a slider co-operating with said fastening means via the action of a first spring and a second spring; and e) an actuating handle operationally connected to said slider, wherein said inner tube is provided with a plurality of recesses adapted to receive, at least partially, said fastening means, further wherein:

f) said outer tube comprises a tunnel for retaining the slider and for guiding it during displacement;

g) said tunnel is formed by suitably shaping said outer tube;

h) said sleeve comprises a recessed area for retaining the slider and for guiding the slider during displacement;

i) said inner tube has a depression forming a channel which extends longitudinally, recesses for said fastening means being provided on a bottom of the channel;

j) said tunnel has two side walls and a ceiling which connects together said two side walls;

k) said tunnel comprises at least two windows formed in the ceiling of the tunnel and a central connecting strip which connects the two side walls of the tunnel, said central connecting strip being provided between said two windows;

l) said actuating handle comprises two teeth; and m) each of said two teeth pass through a respective window of said two windows, and n) said two teeth engage the slider so that when the actuating handle is translated in a longitudinal direction, the slider is translated in said longitudinal direction.

2. The telescopic extension according to claim 1, wherein a surface of said slider is in contact, at least partially, with said central connecting strip in any operating condition of said slider.

3. The telescopic extension according to claim 2, wherein said surface of the slider which is in contact, at least partially, with the central connecting strip is flat and does not have parts projecting from the tunnel.

4. The telescopic extension according to claim 1, wherein said actuating handle comprises a longitudinal recess for receiving said tunnel.

5. The telescopic extension according to claim 4, wherein said two teeth project from the bottom of said longitudinal recess, a distance between the two teeth corresponding to a length of the slider.

6. The telescopic extension according to claim 5, wherein an end surface of said first and second has a rounded form for retaining a respective springs of said first and second springs.

7. The telescopic extension according to claim 1, wherein said recessed area of the sleeve comprises two sections adapted to receive, at least partially, said first and second springs.

8. The telescopic extension according to claim 1, wherein said slider comprises two side holes for receiving a respective end of said first and second springs.

9. The telescopic extension according to claim 1, wherein said actuating handle comprises two pieces and comprises means for locking together the two pieces.

10. An electric household appliance comprising a telescopic extension according to claim 1.

11. The telescopic extension according to claim 1, wherein said slider is retained between the teeth of the actuating handle.

12. The telescopic extension according to claim 1, wherein both said two windows are rectangular shaped.

13. The telescopic extension according to claim 1, wherein said ceiling comprises a first strip which is situated close to, or at, a tunnel entrance, wherein one of said windows is between said first strip and said central connecting strip.

14. The telescopic extension according to claim 13, wherein said one window extends up to said two side walls.

15. The telescopic extension according to claim 1, wherein said ceiling comprises a second strip which is situated close to, or at, a tunnel end, wherein another of said windows is between said central connecting strip and said second strip.

16. The telescopic extension according to claim 15, wherein said another window extends up to said two side walls.

* * * * *